US005087027A

United States Patent [19]

Acquaviva

[11] Patent Number: 5,087,027

[45] Date of Patent: Feb. 11, 1992

[54] DOCUMENT HANDLER STAPLE DETECTOR

[75] Inventor: Thomas Acquaviva, Penfield, N.Y.

[73] Assignee: Xerox Corporation, Stamford, Conn.

[21] Appl. No.: 548,458

[22] Filed: Jul. 3, 1990

[51] Int. Cl.[5] ..... B65H 7/02

[52] U.S. Cl. ..... 271/258; 324/226; 340/675; 361/180; 271/256; 271/165

[58] Field of Search ..... 271/256, 257, 258, 259, 271/263, 109, 126, 265, 165; 324/226; 340/675; 361/180

[56] References Cited

U.S. PATENT DOCUMENTS

| | | | |
|---|---|---|---|
| Re. 31,097 | 5/1977 | Vas et al. | 128/687 |
| 4,128,922 | 12/1978 | Hutchison | 24/30.5 |
| 4,182,315 | 1/1980 | Vas et al. | 128/687 |
| 4,461,465 | 7/1984 | Hartman, Jr. et al. | 271/126 X |
| 4,518,919 | 5/1985 | Ishida | 324/235 X |
| 4,523,750 | 6/1985 | Hubler | 270/53 |
| 4,536,709 | 8/1985 | Ishida | 324/239 |
| 4,764,725 | 8/1988 | Bryce | 324/234 |
| 4,796,497 | 1/1989 | Morita | 83/23 |
| 4,813,205 | 3/1989 | Mikata et al. | 53/53 |
| 4,813,660 | 3/1989 | Dodd et al. | 271/165 X |
| 4,814,734 | 3/1989 | Moran | 324/239 |
| 4,883,264 | 11/1989 | Yoshikawa et al. | 271/258 X |
| 4,974,019 | 11/1990 | Nishioka et al. | 271/265 X |

FOREIGN PATENT DOCUMENTS 0232351 11/1985 Japan ..... 271/256

OTHER PUBLICATIONS

U.S. Defensive Pub. T-958003, issued 5-3-77 to Russel, et al., Japanese Appl. No. 63-37639, 2-22-88, Laid Open as No. 1-213, 671A, 8-28-89, to H. Yushimo (Rikko Co., Ltd).

*Primary Examiner*—H. Grant Skaggs
*Assistant Examiner*—Carol Lynn Druzbick

[57] ABSTRACT

A system for automatically detecting the presence of staples within a set of original document sheets loaded into a document handling tray and automatically inhibiting the operation of the document feeder to prevent damage to the document feeder or the original sheets in response to detecting a staple, particularly a staple in a preselected area of the document tray in which it is most likely that a staple would be present as documents are normally loaded into the document tray by the operator, including preventing inadvertent actuation or output of the staple detector by metal objects other than a staple, such as an operator's ring temporarily present in the document tray during initial loading the documents, preferably by coordinated confirmation of the completion of document loading into the document tray.

2 Claims, 4 Drawing Sheets

DOCUMENT HANDLER STAPLE DETECTOR

The present invention relates to the automatic detection of staples or other such sheet fasteners in a set of plural original document sheets loaded (stacked) into the document feeding tray of an automatic document feeder, from which the document sheets are typically sequentially fed to be imaged or copied in a scanner, printer or copier.

There is disclosed herein a system for detecting staples, paper clips, or other metallic sheet fasteners in their normal position as they are normally loaded into a document feeder tray. The disclosed system can detect such staples or metal paper clips even intermediately of, or buried within, the stack, i.e., even though no portion of the staple or clip is exposed to either of the two outer surfaces of the stack.

Although particularly useful for a recirculating document handler (RDH) or feeder for a copier, the disclosed system is useful in various other automatic or semi-automatic document feeders or handlers for copiers, imagers, scanners or printers, or the like.

The inadvertent loading of stapled or clipped original documents into a document handler is a long-standing, well-known, and serious problem in document handling. Even a loose staple or a staple fastened to only a single sheet can scratch the platen glass or come loose and cause other damage to the document handling apparatus. More typically, two or more of the sheets in the set of original documents loaded into the document handler are still fastened together by a staple, paper clip, or other fastener. When the document handler operates and tries to feed one of these fastened sheets, the document handler cannot separate that document sheet and will attempt to feed all of the sheets fastened together as a "double feed" or "slug" feed. This can jam the document feeder, or cause originals to be damaged. It also confuses the count of the documents which must be made in most document handlers to keep track of the documents as they are sequentially fed to be imaged. If the document handler does double feed, only one of the stapled together sheets can be imaged and the other will be skipped or inadvertently not imaged.

It is known to place warning decals in the tray loading area to warn operators against loading stapled sets, but this has not been successful. In many cases the operator is not even aware that some of the sheets within a thick stack of original documents are stapled together. Modern documents handlers are capable of automatically feeding sets of 20, 50, or even 250 original documents automatically by separating sequentially feeding them and either restacking them in a separate tray or restacking them on top of the stack in the same tray in the case of a recirculating document handler or RDH.

In the system disclosed herein, an electronic, non-contact, staple detector is located in the document tray to detect a staple in a preselected area thereof in which a staple is likely to be found in normal loading of documents. When a staple is automatically detected by the staple detector, the document handler is automatically inhibited from operating to feed documents, and also preferably the document handler or associated copier or printer controller display will display a message on the conventional message display panel or screen instructing the operator to remove staples from the set of originals.

The disclosed embodiment makes use of the fact that stapled documents are almost always stapled in their upper left hand corner if they are conventionally corner stapled. If they are edge stapled, which is less common, they are normally stapled in two or three locations adjacent the left hand edge of the document set. This is as the document set is normally held by the operator in its normal orientation. Furthermore, conventional document handlers are preferably designed so that the documents are loaded into the document handler tray in the normal orientation of the documents relative to the operator approaching the front of the machine. Accordingly, in a document feeder in which the documents are fed long edge first, the corner stapled document will normally have its staples also in the upper left hand corner of the document handler tray, as viewed looking down at the document handler tray from above. This corresponds to the left rear corner of the document tray looking at the document tray from the front thereof as approached by the operator.

Thus, it has been discovered in connection with the present invention that the vast majority of staples can be detected by positioning an electrical field staple detector in the general area in which staples are most likely to be found as loaded into the document tray. That is, it has been found that it is not necessary to have a document set staple detection system which detects staples anywhere or everywhere in the tray or over the entire area of the tray in which documents may be loaded in order to provide effective protection against loading staples in the document handler in the vast majority of cases.

By way of background, the use of electrical field type metal detectors to detect the inadvertent presence of medical metal staples or the like in the human body and is noted, for example, in U.S. Pat. No. 4,182,315, U.S. Pat. No. Re. 31,097, etc. The use of metal detectors for the detecting of metallic substances such as a staple in a packaging device, or in the production of food stuffs, etc., is, of course, also known, e.g. U.S. Pat. No. 4,813,205 to Mikata et al. This is also noted in U.S. Pat. No. 4,128,922 to Hutchison. Other metal detectors for staples are used in other applications, such as U.S. Pat. No. 4,796,497 to Moorita. Metal detectors are sold by "Radio Shack" and other stores for finding coins and other metal objects in beach sand, etc. These patents products are of general interest for examples of various suitable metal detector circuitry noted or cited therein. Since such metal detectors per se, and their circuitry, are well known in the art, an example thereof need not be described in detail herein.

The detection of paper staples by direct electrical contact with and/or through the staple is known. They may be used directly in association with the stapler mechanism itself in a finisher for finishing sets of copy sheets, as in U.S. Defensive Publication T-958003 issued May 3, 1977 to Russel et al.; or in a staple feeder or magazine as in U.S. Pat. No. 4,523,750 to Hubler; or as in Japanese Appln. No. 63-37639, Feb. 22, 1988, laid open as No. 1-213,671A, Aug. 28, 1989, to H. Yushimo (Rikko Co. Ltd.). The latter requires upper and lower conductive rollers contacting the top and bottom parts of the staple through the stack. As in all of these direct contact devices, they are only capable of operation if the staple is clearly exposed on one or both sides of the set of original documents loaded into the document tray. As noted above, this cannot be used to overcome the more serious problem of a partial subset of stapled or clipped documents which is intermixed with other unstapled sheets and not exposed to the operator and, therefor, unnoticed in loading the document handler. Furthermore, these direct electrical contact devices require not only direct contact surface but some means such as an overlying pressure arm or pressure roller system to press the stack down against the electrical contact surface, particularly since originals often have curled edges or are otherwise irregular. That is, even if a staple was exposed on the bottom of the stack resting in the tray, it may not make positive electrical contact without an overlying pressure member as in said Yushimo Japanese reference. Furthermore, such a pressure system would require some mechanical system for resetting on top of the stack or preventing interfering with restacking in the case of a recirculating document handler. Even existing document set separator arms, with much lower pressure, are prone to mechanical reliability problems, and can cause skewing or other interference with sheet feeding.

In contrast, in the disclosed system, a simple, completely non-contact, staple detector may be utilized with a suitable, conventional or other printed circuit or other coil oscillator metal detector in the normal staple underlying area of the document tray and operated by a low cost conventional integrated circuit for establishing a weak magnetic or radio frequency field. A conventional threshold detector or trigger level circuit associated therewith can detect a change in the inductance or load in the field of the oscillator coil indicative of a detected metal object of any kind. Alternatively, if desired, it may be preset or specially tuned to be triggered by a metal object of the mass and/or size of a conventional standard metal staple. Furthermore, the field sensitivity of the metal detector is preferably set to respond to a metal object within less than approximately one inch (2.5 cm) of the metal detector and tray surface level, so as only to respond to potential staples or clips in a document stack loaded into the document handler tray, and not to respond to any external metal objects. Thus a very weak field detector may be utilized, because of the close proximity of the object being detected in all cases.

Likewise, the detector circuit is preferably only interrogated at a time after document loading and before the document handler would normally begin to feed documents. This may be after a start of feeding or start of copying command but before actual feeding starts. The prevents the detector from being triggered by a metal ring or other object on the operators finger as the stack of documents is being loaded into the tray. That is, the subject metal detector system is preferably only responsive to metal detection at a time delay after the operator has already loaded the documents and the operator's hand or other metal objects would not be present in the document handling tray. Thus, positive prior confirmation of stack loading by a positive document presence sensor, as further described herein, is preferred.

It is appreciated, of course, that some documents may be in what is called "landscape" rather than the normal or "protrait" imaging or reading mode, particularly pictorial material. In such cases, even though corner stapling will normally be at the upper left hand corner thereof, it is possible that in some cases this will be in the front left hand side of the document tray as loaded for long edge feeding.

It is also appreciated that some document handlers are so-called short edge feeding rather than long edge feeding. That is, for example, a standard U.S. letter size or 8½ inch by 11 inch document would be fed by the document feeder from its 8½ inch, a short edge, dimension rather that its 11 inch dimension as in the case of a long edge first document feeder. In this case, of course, the normal loading orientation and most likely staple location is in the upper right hand corner of the document tray instead. Thus, the preferred staple detector location may vary with the document feeding mode.

As to the disclosed exemplary recirculating document handler (RDH) or document feeder, per se, it may desirably, with only minor control function modifications as described herein, be of a known type. Such RDH's are well known for use with conventional optical light-lens copiers, and may also be used with an electronic document scanner imaging system.

By way of background, disclosed herein by way of such example of an RDH is a well known dual input type RDH, an RDH/SADH. RDH/SADH is a common abbreviation for a well known type of document handler with a top tray document loading recirculating document handler (RDH) mode and an integral alternative side document entrance or SADH slot providing a semiautomatic document handler (SADH) unidirectional document input. This disclosed RDH system allows documents to be automatically or semiautomatically fed onto an imaging platen from either infeeding position. Examples of patents thereon are cited below. However, this is merely exemplary, and the present invention is not limited to any particular type of documents stack handler or document stack feeder.

An example of an electronic document imaging and printing system is disclosed in Xerox Corporation U.S. Pat. No. 4,757,348 issued July 12, 1988 to Rourke, et al and commonly filed U.S. Pat. No. 4,716,438 issued Dec. 29, 1987. That is compatibly usable with the present system, if desired. Among many other examples of platen scanning electronic imaging system per se are Xerox Corporation U.S. Pat. No. 4,295,167 or related U.S. Pat. No. 4,287,536. The terms copying and imaging are used interchangeably in this particular case.

Also as to specific hardware components of the subject apparatus, it will be appreciated that, as is normally the case, various such specific hardware components are known per se in other apparatus or applications, including that described in art cited herein, and need not be redescribed herein. Particularly noted re the disclosed RDH document handling system is Xerox Corporation U.S. Pat. No. 4,579,444, issued Apr. 1, 1986 to Pinckney and Sanchez, and/or other RDH art cited therein. Said U.S. Pat. No. 4,579,444 patent is of appropriate background interest as illustrating the general nature of the specific embodiment of the disclosed document handler and platen. Some other examples of prior art recirculating document handlers are disclosed in U.S. Pat. No. 4,278,344 issued July 14, 1981 to R. B. Sahay; U.S. Pat. No. 4,270,746 issued June 2, 1981 to T. J. Hamlin, and U.S. Pat. No. 4,076,408 issued Feb. 28, 1978 to M. G. Reid, et al. Also, in U.S. Pat. Nos. 4,176,945; 4,330,197, 4,466,733; and 4,428,667.

Set separators are well known in RDH's to tell when one complete feed out for circulation of the document set or stack by the RDH has been accomplished, before the nest document set circulation. That is, to separate or distinguish those document sheets to be fed from those which have been returned to the document tray following the copying operation. The set separator or bail bar system typically has an arm or bail that is set on top of the stack of documents and drops down to actuate switch when the last sheet of the set is fed out from under the arm. That is, when the finger is no longer over any documents it drops to signal that all the documents in that set have been fed out of the RDH tray once to copied. The finger or bail may then be automatically reset to the top of the stack to initiate another feed cycle, by a solenoid or other drive mechanism which pulls the finger back and then lifts up to the reset position. This is needed to tell the system each time the complete document set is circulated, i.e. to keep track of the number of set circulations when there are recirculations. This is all described, for example, in Xerox Corporation U.S. Pat. No. 4,589,645 issued May 20, 1986 to M. J. Tracy, and art cited therein.

Such set separators can also be cycles before the start of any document feeding to see if the arm drops immediately, which signals that no documents are present in the document feeder tray. If the arm does not drop immediately, then it is confirmed that one or more document sheets have been loaded into the tray.

U.S. Pat. No. 4,076,048 issued Feb. 28, 1978 to M. G. Reid, et al also discloses a separate optical emitter/detector 149, 151 in the document tray, which many be used to detect the presence (loading) or absence of any documents in the tray at a preset sensor interrogation time in a known manner. A similar disclosure is in U.S. Pat. No. 4,099,860 issued July 11, 1978 to J. L. Connin. More typically, such document tray document presence sensors are a conventional integral corner bottom light beam sensor unit, in which a light transmitter on the registration side wall slightly above the tray bottom transmits a light beam downwardly at an angle into an adjacent receiver or sensor in the tray bottom, and this light beam is occluded by any (even one) document sheet in the tray lying on the tray bottom. This information is normally used to tell the copier controller that the RDH tray mode of operation was in use, or, in clearing a jam, that there was a document to be removed and the reloaded with others in the document tray.

As noted in the prior art, as xerographic and other copiers and document imagers increase in speed, and become more automatic, it is increasingly important to provide higher speed yet more reliable and more automatic handling of the plural document sheets being imaged, i.e. the input to the imager and/or copier.

In the description herein the term "document" or "sheet" refers to a usually flimsy sheet of paper, plastic, or other such conventional individual image substrate, and not to microfilm or electronic images which are generally much easier to manipulate. The "document" is the sheet (original or previous copy) being imaged, or copied in the copier onto the "copy sheet", which may be abbreviated as the "copy". Plural sheets of documents being imaged as a group in some desired related arrangement, even if not in an actual page order, or their copies, are referred to as a "set". A "duplex" document is a sheet desired to be copied on both sides, as opposed to a "simplex" or single side imaged document.

A specific feature of the specific embodiment disclosed herein is to provide, in a document feeder for sequentially feeding document sheets from a document tray in which a set of original documents are loaded for separation and feeding, the improvement comprising a non-contact staple detection means including an electrical field generating means underlying a pre-selected portion of said document tray in which staples are most likely to be found in a set of documents loaded into said tray, said staple detecting means being responsive to the presence of a staple in said set of documents within a limited distance of the bottom of said document set supporting surface of said tray.

Further specific features provided by the system disclosed herein include those wherein said staple detection means is interrogated in time periods in which it is unlikely that metal objects other than a staple will be present within said document tray to actuate said staple detection means, and/or wherein the document feeder indicating means for detecting the stacking of a set of document sheets into said trays, and wherein said staple detection means is interrogated after a preset time delay.

Another disclosed function is to provide a method of preventing feeding of stapled document sheets in a document feeder with a document tray into which documents are stacked to be fed, comprising generating a low powered electrical field with a metal detection means in a limited area above the stack supporting surface of said document tray for detecting staples within said stack adjacent to the stack supporting surface of said tray in said limited area and inhibiting feeding of document sheets from said stack in response to said staple detection.

Another disclosed function is to provide a method of preventing the feeding of stapled document sheets, wherein the staple detection means is interrogated in time periods in which it is unlikely that metal objects other than a staple will be present within said document tray to actuate said staple detection means.

The disclosed apparatus may be readily operated and controlled in a conventional manner with conventional control systems. Some additional examples of control systems for various prior art copiers with document handlers, including sheet detecting switches, sensors, etc., are disclosed in U.S. Pat. Nos. 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general, and preferable, to program and execute such control functions and logic with conventional software instructions for conventional microprocessors. This is taught by the above and other patents and various commercial copiers. Such software will of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems. As shown in the above-cited art, the control of exemplary document and copy sheet handling systems in copiers may be accomplished by conventionally actuating them by signals from the copier controller directly or indirectly in response to simple programmed commands and from selected actuation or non-actuation of conventional copier switch inputs by the copier operator.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus the present invention will be better understood from this description of an embodiment thereof, including the drawing figures (approximately to scale), wherein:

Figure 3:
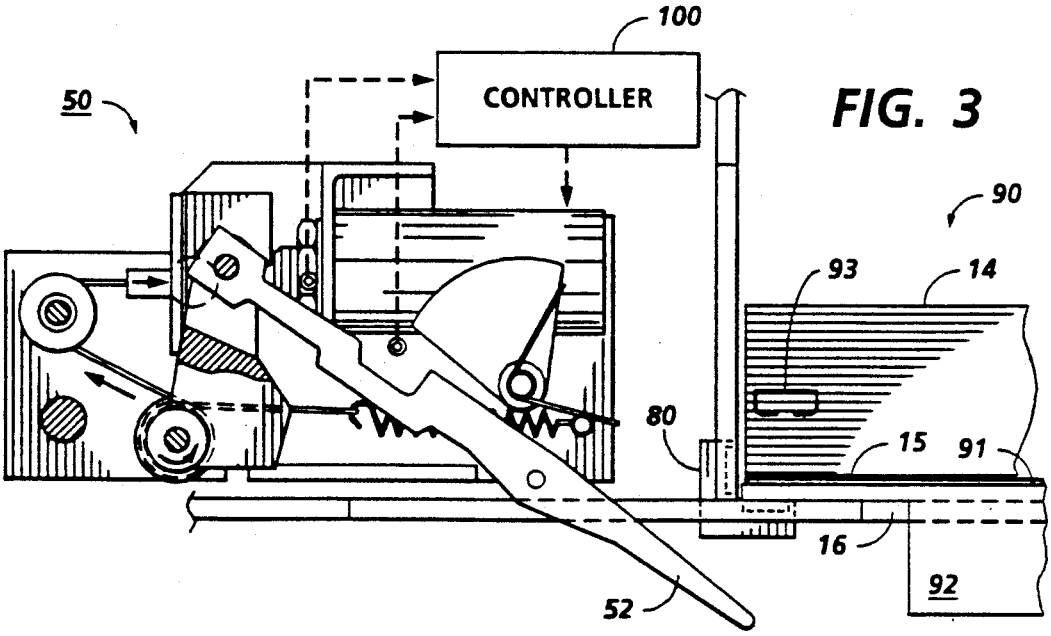
FIG. 3 is an enlarged partial side or end view of the system of FIGS. 1 and 2.
Figure 4A:
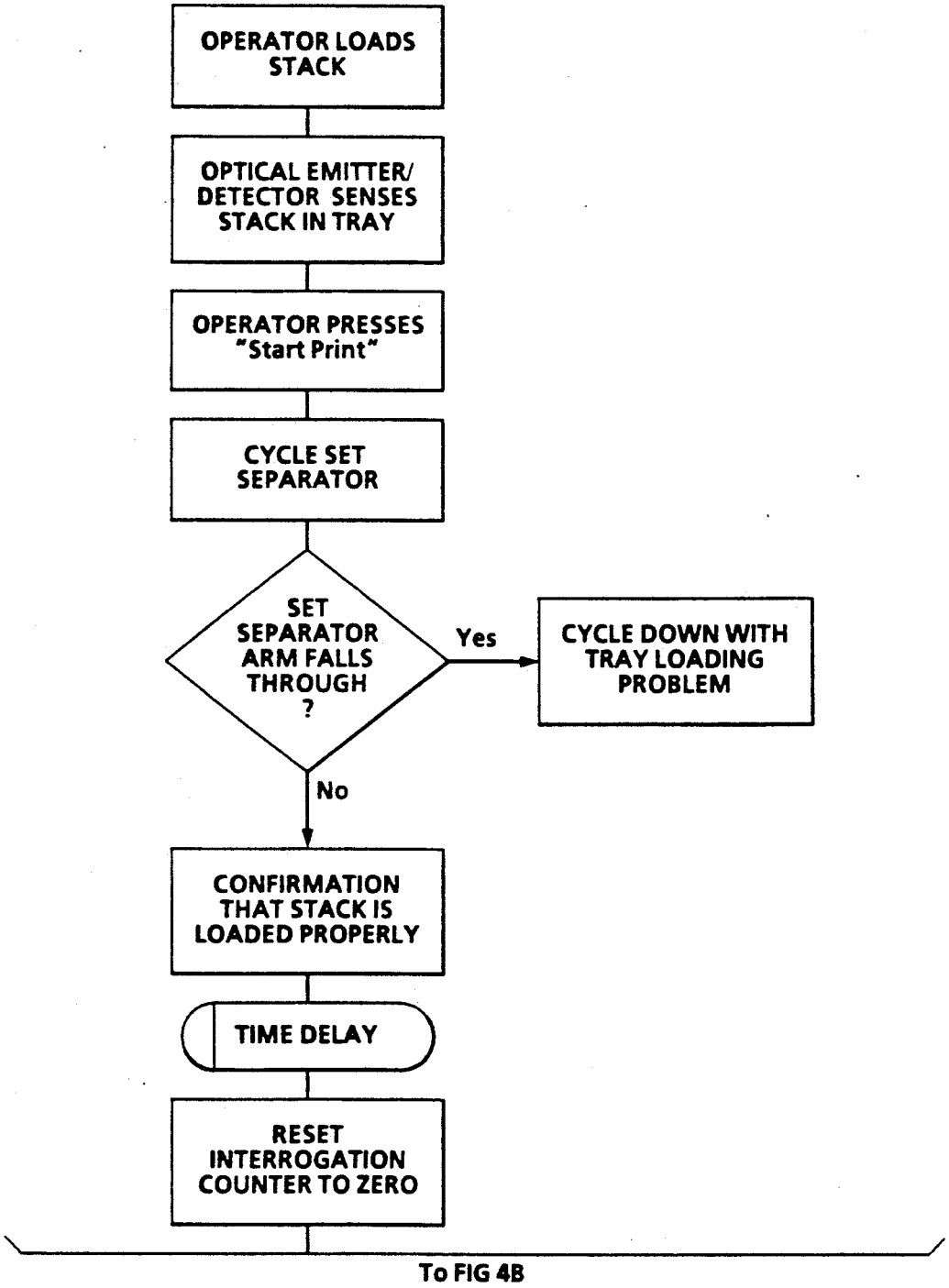
FIG. 4 is one example of a flow chart illustrating an exemplary operation of the exemplary system of FIGS. 1-3.
Figure 4B:
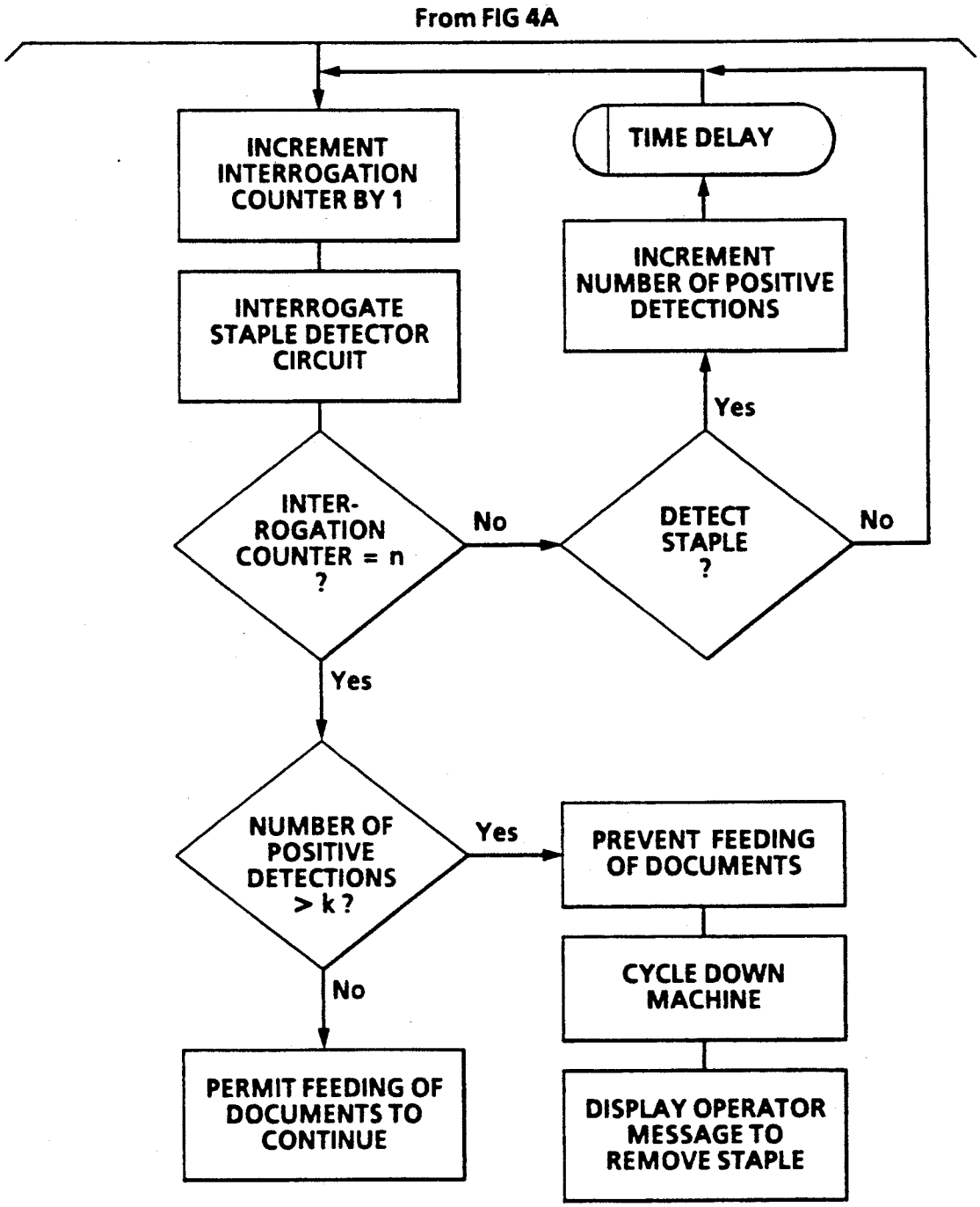

As illustrated, and as previously described above, the exemplary staple detection and control system 90 here in this exemplary long edge feeding document handler 20 may have a detection area located under the upper left hand corner of the tray 16 or the entire left hand edge area of the tray 16. The metal detector coil 91 may be flat and co-planar the tray 16 bottom 15. It is directly connected to a suitable or conventional metal detector circuit 92 which may be constructed of conventional integrated electronic components to preferably provide a relatively high frequency relatively weak signal to the coil 91. Conventional integral detection and trigger level circuitry is included therein. The output is, as shown, connected to the conventional controller 100 to provide, when interrogated by the controller 100, a signal indicative of the detection of a metal staple within the limited field of the coil 91, as previously described. One example of a detectable staple buried within the document set or stack is shown in FIG. 3. That is, the field and/or trigger level are preferably set to detect staples within, but not beyond, the maximum stack thickness for that document handler, or, in general, not more than about 3 cm or one inch above the bottom of the tray stacking surface 15.

As noted above, this staple detection can prevent the document handler 20, and any associated printer or copier, from cycling up or operating until the set of documents containing the staple is removed from the tray. The copier controller 100 preferably has a conventional associated display screen which desirably also contains a "prompt" or operator display instructions to remove the stack of documents and remove the staple therefrom before document feeding can commence.

As noted, the staple detector interrogation preferably occurs after document loading has been confirmed, and/or after the machine has been instructed to feed documents, so as to ensure that the operator has already loaded the documents and has removed his or her hand from the tray. As to the operation of the staple detection and control system 90 disclosed herein, the general principles have already been described above. Preferably also connected to the controller 100 is a known set separator 50, with a set riding arm 52, and/or a document presence sensor 80. These may be as described above in regard to cited art on such devices. The optical document presence sensor 80 signals the loading of documents in the tray, and the operation of the set separator 50 can do this also. The set separator 50 can positively confirm this by the arm 52 remaining held up by the stack, as described in the cited art. Either or both can desirably provide a coincidence or start signal or a time count after which the staple sensor or detector 90 can be operated or interrogated.

Alternatively or additionally, the interrogation of the metal detectors can be sampled at preset time intervals and the presence of a staple indicated only if several sequential staple signals are received at these separated sampling times. That also ensures that the temporary presence of a metal object in the tray other than an object within a set of documents in the tray will not provide a staple warning and control signal to inhibit document feeding. This preferred time limited and/or plural sensor output sampling also acts as a filter for avoiding erroneous signal readings due to sensor noise or stack disturbance anomalies.

Describing in further detail the exemplary embodiment with reference to Figures, there is disclosed an automatic, in situ, non-contact, hidden staple detection system 90 as a part of an exemplary integral document handling and imaging or copying system 10 with a recirculating document handler 20 shown by way of one example of a document handler for use with and/or control by the subject staple detection and control system 90.

The RDH 20 may be conventional and may be mounted to, as a part of, any conventional copier or scanner. Furthermore, the present system is applicable to numerous other sheet feeding systems, of which this is merely one example. Nor is the present system limited to use in an RDH. It has applicability to various other types of document feeders. Further details are described in the above-cited and other references, and need not be repeated herein. The illustrated exemplary document handler 20 is an dual input RDH/SADH unit very much like that shown in the above-cited Xerox U.S. Pat. No. 4,579,444 issued Apr. 1, 1986. Thus, this RDH 20 may be basically as described in that patent, except as to the novel aspects described herein. Likewise, the RDH/SADH 20 and its drives and sensors are generally conventionally connected to and controlled by a conventional programmable controller 100, programmed as further described herein.

In this otherwise conventional recirculating document handler 20, a set or stack 14 of individual flimsy document sheets are loaded into the generally horizontal and planar bottom stack supporting surface 15 of a document loading and stacking tray 16 to be separated and fed seriatim long edge first from the bottom of the stack 14 by a vacuum belt or other individual sheet output feeder 17, preferably conventionally assisted by an air knife, as shown, both of which are adjacent the front of downstream edge of the stack 14. That is, normally, as described in the cited and other art, a set or stack 14 of normal sized documents is placed by the operator in the RDH 20 top document tray 16. The documents are then automatically sequentially fed from the tray 16 by a pneumatic bottom separator/feeder 17 to be imaged on platen 30 via path 19.

In this particular example, each document sheet, after it has been fed out to the copier platen 30 and copied, may be returned via a restacking feeder or transport which feeds the returning sheet in over the top of the stack 14 from the rear of the stack and releases the sheet to restack by settling down on top of the stack between aligning edge guides. Thus, the document sheets can be continuously recirculated, in the same order, as often as desired, as in a normal RDH.

Figure 1:
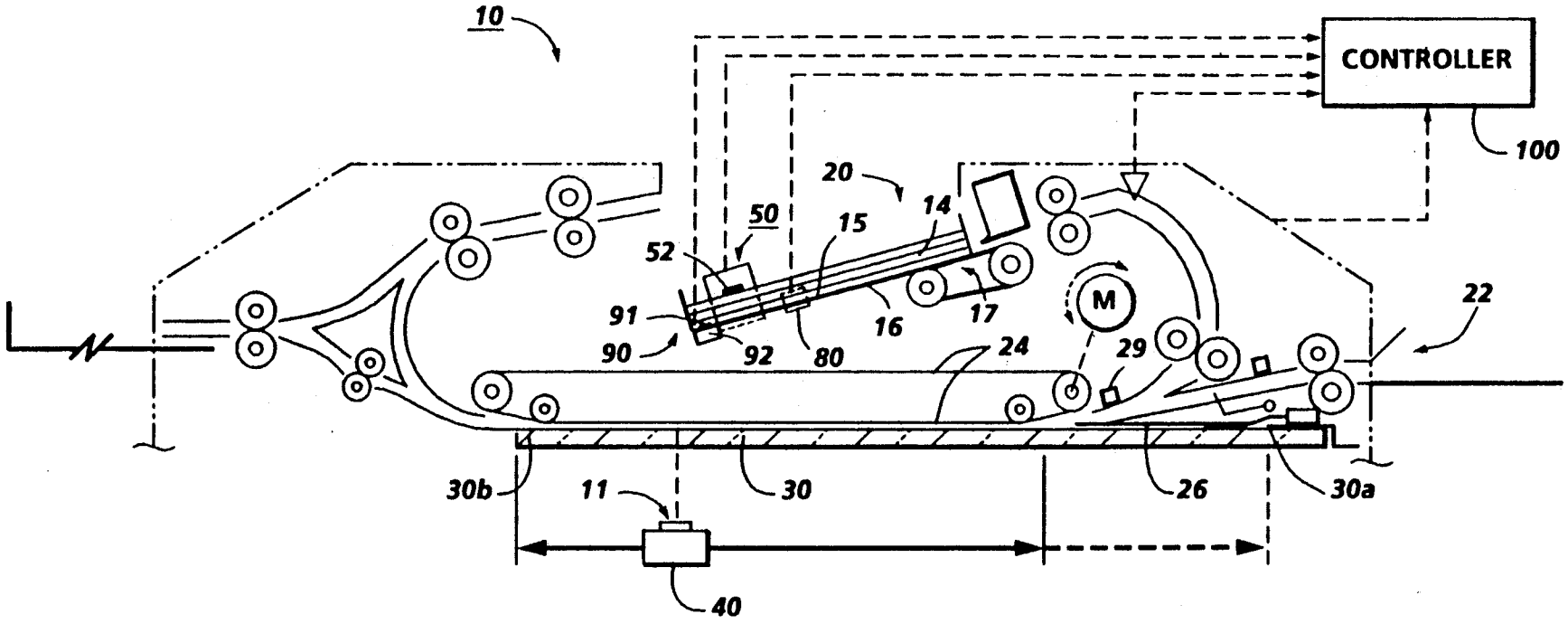
FIG. 1 is a schematic front view of one example of the automatic staple detection system of the invention shown in one example of a conventional recirculating document handler.
Figure 2:
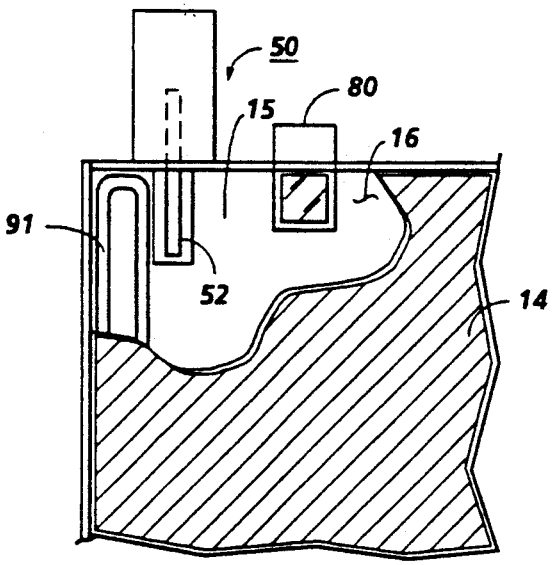
FIG. 2 is an enlarged partial top view of the document tray of the document handler of FIG. 1, further illustrating the system of the invention.

The disclosed electronic document imaging system 11 may be utilized in lieu of a conventional light-lens imaging system for electronic document imaging for a subsequent or integral printer. The electronic optical scanning system 11 reads document images on the imaging platen 30. As disclosed here schematically in FIG. 1, an exemplary electronic image scanning system 11 may be provided scanning from under the platen 30 with a scanner 40 which may be mounted on and reciprocally driven by a typical horizontal optical scanning carriage. The electronic image scanning system 11 here provides for scanning up to the full length or the entire area of the platen 30, from the ends 30*a* to 30*b*, (see the movement arrows) to be able to image a document of any size which can be fitted onto the platen 30 upper surface. Conventionally, a document illuminating lamp and reflector light source may be located on the same scanning carriage.

The electronic imaging member 40 may be a conventional full width imaging bar or scan head CCD sensor array, preferably with an integral conventional lens strip such as a well known Selfoc TM multi-element lens or fiber optics array, as in U.S. Pat. No. 3,977,777, for example. Such electronic digitizing of the document image, for integral or separate digital copying, printing, facsimile transmission, and/or other digital image processing, enhancement, and/or manipulation, is rapidly becoming more important and critical, as compared to conventional copying with conventional light lens optical input, or the like. This is sometimes called an "EFE" or "electronic front end". Examples included Xerox Corporation U.S. Pat. Nos. 4,757,348, 4,295,167 and 4,287,536. The electronic image scanning may be bidirectional, as is known for example from Eastman Kodak U.S. Pat. No. 4,150,873 issued Apr. 24, 1979 to G. Dali and Xerox Corporation U.S. Pat. No. 4,205,350. Also, various electronic buffer and page collation systems may be connected to or made a part of the EFE, as disclosed in above-cited references, IBM Corp. U.S. Pat. No. 4,099,254 or U.S. Pat. No. 4,213,694; Eastman Kodak Canadian 1,086,231 or UK 1 531 401; the Xerox Corporation "1200" and "9700" printers, etc.

With the document handler 20, normal sized documents are fed and registered and ejected entirely unidirectionally on the platen 30, in a generally conventional manner, with the servo-driven non-slip platen transport belt 24. Thus, normal size automatically fed documents are registered in a registration position under the platen transport belt 24, downstream from the baffle 26.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a document feeder for an imaging system for sequentially feeding document sheets from an open, coverless document tray with a document set stack supporting surface onto which a set of document sheets are stacked for separation and sequential bottom sheet feeding; the improvement comprising non-contact metal staple or paper clip detection means including electrical field generating means underlying only a minor, limited, pre-selected portion of said document tray in which staples or clips are most likely to be found in a set of documents stacked onto said tray, said staple detecting means being responsive to the presence of a staple or clip in the set of documents within a limited distance above said document set stack supporting surface of said document tray; document loading detection means for detecting and indicating the stacking of document sheets into said document tray, and control means for inhibiting interrogation of said staple detection means until after a time delay after said document loading detection means has detected said stacking of documents sheets into said document tray so that said staple detection means is only actuated after the set of document sheets has been stacked into said tray, and prior to said feeding of said document sheets, to prevent feeding of stapled document sheets by said document feeder by said staple detection means being interrogated in time periods in which it is unlikely that metal objects other than a staple or clip will be present within said document tray to actuate said staple detection means; said staple detecting means generating a limited effective distance metal detection electrical field in a limited area above said stack supporting surface of said document tray for detecting a staple or clip within said document stack adjacent to said set stack supporting surface of said document tray in said limited area, and providing a control signal for inhibiting feeding of document sheets from said stack in response to said metal detection.

2. The document feeder of claim 1, wherein an operator warning display is provided in response to said detection of staples or clips within the document stack adjacent said set stacking supporting surface of said document tray.

* * * * *